United States Patent [19]

Ledenican

[11] Patent Number: 4,475,300

[45] Date of Patent: Oct. 9, 1984

[54] SIGN BOARD

[76] Inventor: Robert L. Ledenican, 8656 Hilltop Dr., Mentor, Ohio 44060

[21] Appl. No.: 350,065

[22] Filed: Feb. 18, 1982

[51] Int. Cl.[3] ..... G09F 7/04

[52] U.S. Cl. ..... 40/600; 40/611; 40/490; 40/491

[58] Field of Search ..... 40/611, 1.5, 124, 1.6, 40/600, 585, 152, 575, 152.1, 16, 154, 576, 155, 574, 156, 491, 157, 492, 10 D, 10 B, 10 A, 10 R, 489, 490, 491, 576, 621; 52/789; 211/DIG. 1

[56] References Cited

U.S. PATENT DOCUMENTS

| | | | |
|---|---|---|---|
| 218,883 | 8/1879 | Hopkins | 40/611 |
| 923,335 | 6/1909 | Cornelius | 40/611 |
| 1,320,270 | 10/1919 | Phelps | 40/611 |
| 3,456,374 | 7/1969 | Baerman | 40/152 |
| 3,740,879 | 6/1973 | Patterson | 40/600 |
| 3,866,343 | 2/1975 | Frost et al. | 40/611 |
| 4,255,837 | 3/1981 | Holtz | 40/1.5 |

*Primary Examiner*—Gene Mancene
*Assistant Examiner*—John G. Weiss
*Attorney, Agent, or Firm*—Fay & Sharpe

[57] ABSTRACT

Front and rear sign board panels are releasably held together in slightly spaced relationship by magnet strips. The strips also cooperate with the panels to define at least one pocket which includes an opening for receiving an indicia bearing member.

15 Claims, 9 Drawing Figures

SIGN BOARD

BACKGROUND OF THE INVENTION

This application relates to the art of sign boards and, more particularly, to sign boards of the type carrying messages which are frequently changed. The invention is particularly applicable to sign boards of the type used in diners, restaurants, or the like and will be described with specific reference thereto. However, it will be appreciated that the invention has broader aspects and can be used for displaying various other types of information in written form, or in the form of drawings, pictures, or symbols.

A known type of sign board includes generally horizontally extending pockets which are open along at least one side of the board for inserting message bearing strips into the pockets and removing same therefrom. In a sign board of this type, the interior surfaces of the pockets often become very dirty. At least in part, this is due to the fact that such sign boards are commonly located in restaurants where airborne particles produced by preparation of food can penetrate the pockets. In addition, persons inserting message bearing strips into the pockets may be careless and cause dirt to be transferred into a pocket by inserting a message bearing strip which itself is dirty. Although a dirty sign board does not normally create a health hazard to patrons of a restaurant or the like, it can be very distasteful and otherwise noxious to the patrons, as well as obscuring the messages thereon. For these reasons, it would be desirable to have a sign board which could be thoroughly cleaned on the interior surfaces thereof if so desired.

SUMMARY OF THE INVENTION

A sign board of the type described includes front and rear panels releasably held together in slightly spaced-apart relationship by magnet strips which also cooperate with the panels to define at least one pocket for receiving a message or indicia bearing member. With this arrangement, the front and rear panels can be separated from one another if so desired by pulling same apart with a force greater than the holding power of the magnet strips. The interior surfaces of the panels can then be thoroughly cleaned and the sign board can be reassembled simply by re-engaging the magnet strips.

In a preferred arrangement, the front and rear panels are hingedly connected adjacent their top edges by a substantially flat plastic strip which is longitudinally folded along a hinge line. The hinge line is located adjacent and parallel to the top edges of the panels. The portions of the plastic strip on opposite sides of the hinge line define hinge plates which are bonded to the interior surfaces of the panels adjacent the top edges thereof.

The front and rear panels are releasably held together by releasable holding means which allows separation of the panels by swinging same from one another about the top hinge means connecting same.

Also, the sign board includes a plurality of pockets spaced-apart from one another in a direction between the top and bottom edges of the panels, and are elongated in a direction extending between the opposite sides edges of the panels. The pockets are outwardly open along at least one side edge of the panels for permitting insertion and removal of message or indicia bearing strips into the pockets.

At least the front panel of the sign board may comprise a transparent acrylic plastic material. This front panel may be masked on the interior surface thereof to define a plurality of transparent windows which are spaced-apart from one another between the top and bottom edges of the panels, and which are elongated in a direction extending between the opposite side edges of the panels. In this arrangement, the magnet strips are bonded to the interior surfaces of the panels along the masked areas thereof.

In a preferred arrangement, the top and bottom edges of the pockets include grooves having a width perpendicular to the panels which is substantially less than the thickness of the pockets between the inner surfaces of the panels. This makes it possible to install a message or indicia bearing strip having a thickness substantially less than the thickness of the pockets. The grooves are preferably located in a position for holding the message bearing strips in spaced relationship to the inner surfaces of the panels. In the most preferred embodiment, the grooves are located centrally between the inner surfaces of the front and rear panels for holding a message bearing strip in spaced relationship to both of the opposite surfaces of the pockets. With such an arrangement, even if the message bearing strips themselves are dirty, the dirt will not be transferred to the inner surfaces of the panels.

The sign board of the present application is arranged for hanging to a vertical wall surface by its rear panel. The holding means or magnet strips include interdigitating means for preventing downward transverse movement of the front panel relative to the rear panel. This interdigitating means may take the form of cooperating tongues and grooves on the magnet strips.

The principal object of the present invention is the provision of an improved sign or display board having interior surfaces which can be easily cleaned.

It is a further object of the invention to provide such a board having improved features for minimizing contamination of interior surfaces thereof when inserting or removing a message or indicia bearing member.

Another object of the invention is the provision of an improved sign board which is very economical to manufacture and assemble, and is very easy to maintain.

An additional object of the invention is to provide an improved sign board having front and rear panels held together by magnet strips which also perform the function of cooperating with the panels to define pockets therebetween for receiving message or indicia bearing strips.

Still further objects and advantages for the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF A PREFERRED EMBODIMENT

Figure 1:
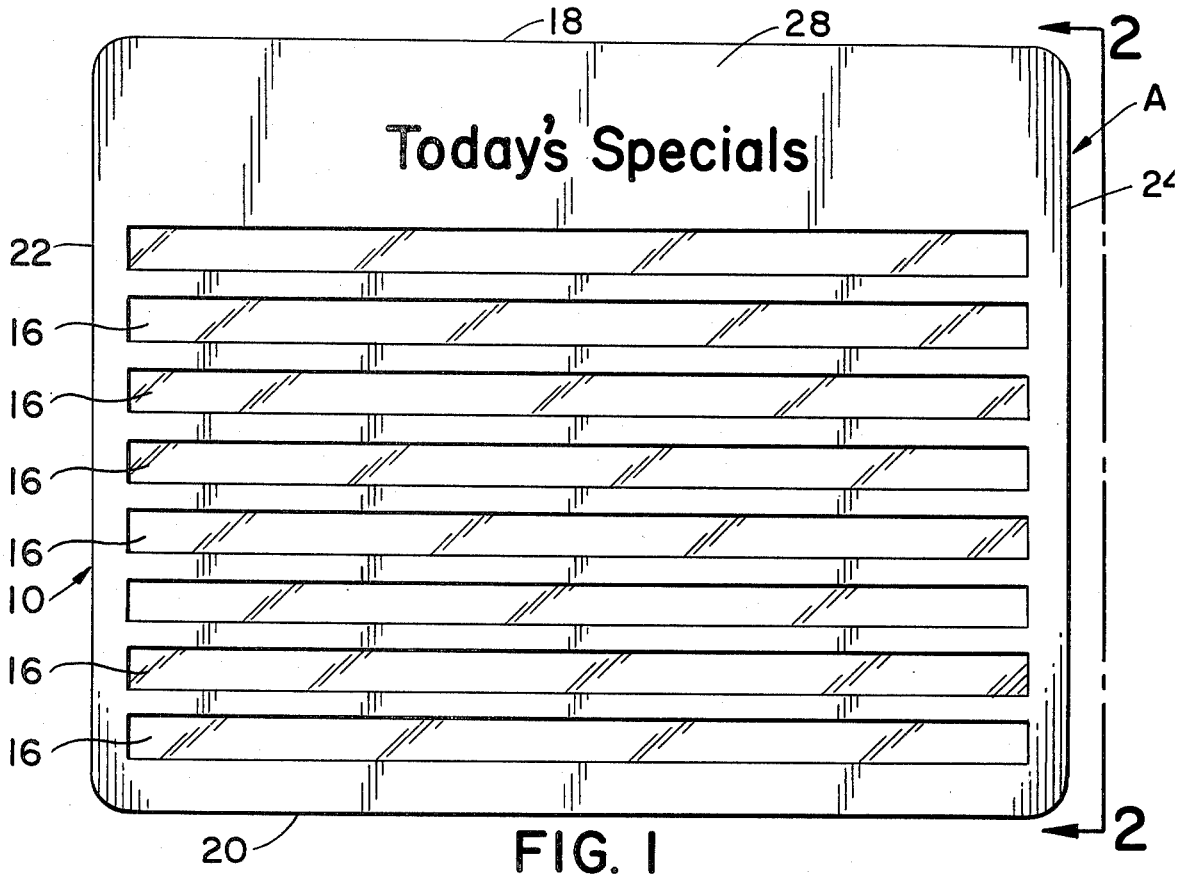
FIG. 1 is a front elevational view of a sign board constructed in accordance with the present invention.
Figure 3:
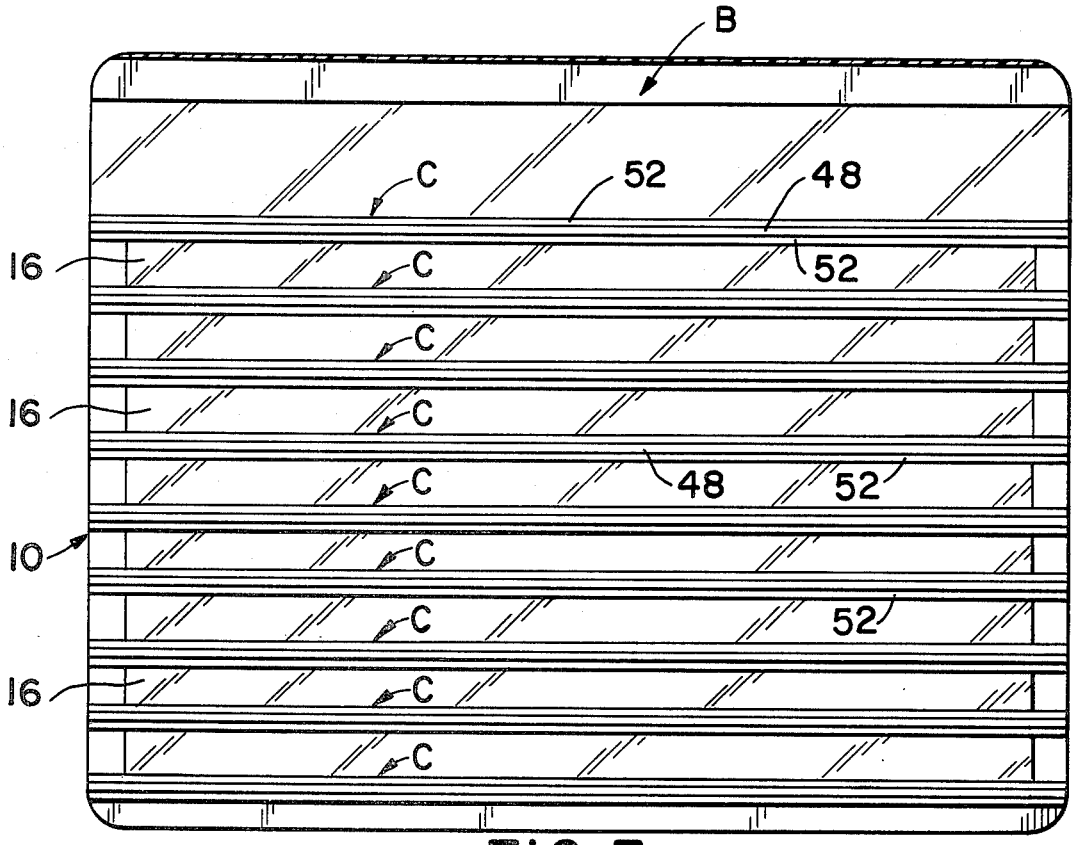
FIG. 3 is an elevational view showing the inner surface of a front panel of the sign board looking generally along lines 3—3 of FIG. 2.
Figure 2:
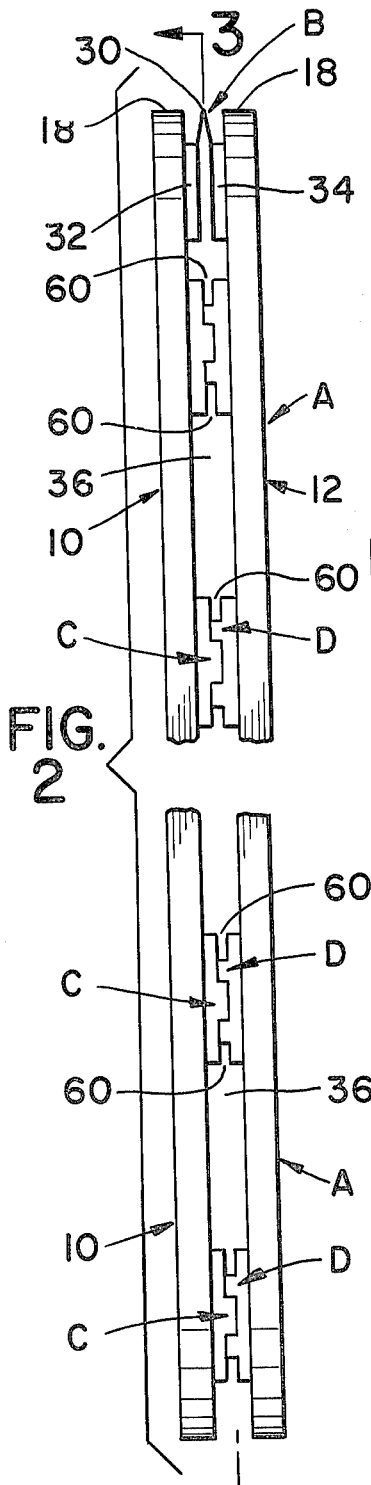
FIG. 2 is an end elevational view taken generally along lines 2—2 of FIG. 1.

With reference to the drawings, wherein the showings are for purposes of illustrating a preferred embodiment of the invention only and not for purposes of limiting same, FIGS. 1 and 2 show a generally rectangular sign board A including front and rear panels 10, 12. As used herein, the term sign board is deemed to include all display boards and the like employed in various environments to convey information, visual images, and so on to others. In the preferred embodiment, panels 10, 12 are substantially rigid in nature although panels having flexible characteristics could also be suitably and advantageously employed.

Although panels 10, 12 can be of many different materials having different strength and physical characteristics, in the preferred embodiment shown, at least front panel 10 is advantageously of transparent plastic material such as acrylic or the like. The inner surface of front panel 10 is masked in selected areas as by silk screening or otherwise applying an opaque coating thereto, to provide a plurality of transparent windows 16 which are spaced-apart from one another in a direction extending between top and bottom edges 18, 20 of the panels, and are elongated in a direction extending between opposite panel side edges 22, 24. The entire inner surface of front panel 10 outside of windows 16 is masked and the color of the masking paint is visible through the transparent panel. Thus, sign boards can be manufactured to match various decorating schemes. The inner surface of front panel 10 is masked around the entire periphery thereof and along strips extending between adjacent windows 16. The top peripheral portion of front panel 10 has a wider masking area generally indicated in FIG. 1 by numeral 28 for providing a message on the board. FIG. 1 simply shows the message "Today's Specials" silk screened or otherwise imprinted on the outer surface of front panel 10 in a color which contrasts with the masking color on the inner surface of the panel. Obviously, messages or indicia of other types may be imprinted on area 28 depending upon where the sign board will be used. Rear panel 12 is preferably opaque and may be formed of an opaque plastic material such as acrylic which is either coated with an opaque material throughout its entire surface area or is originally compounded with an opaque filler material incorporated therein. Of course, the subject new concept may be advantageously adapted to use with other sign board arrangements without in any way departing from the scope of the invention involved.

With reference to FIG. 2, front and rear panels 10, 12 are hingedly connected together adjacent their top edges 18 by hinge means in the form of an elongated plastic hinge strip B which is longitudinally folded along a hinge line 30 to provide opposite flat hinge plate portions 32, 34 which are bonded to the inner surfaces of panels 10, 12 as by the use of adhesive or fusion, or by the use of plastic foam tape having pressure-sensitive adhesive on both opposite surfaces thereof. Hinge line 30 is preferably defined by a groove or weakened portion of plastic strip B extending along the entire length thereof. Hinge line 30 extends parallel to top edges 18 and, in the arrangement shown, lies in substantially the same horizontal plane therewith. The hinge means defined by plastic strip B is completely concealed between panels 10, 12 and extends substantially the entire length of such panels between opposite side edges 22, 24 thereof.

Opposed pairs of elongated magnet strips C, D are bonded to the inner surfaces of panels 10, 12 for releasably holding panels 10, 12 together in slightly spaced-apart parallel relationship and define a plurality of elongated pockets 36 therebetween. Pockets 36 extend the full width of sign board A and open outwardly along both opposite side edges 22, 24. Elongated magnet strips C, D preferably extend the full width of sign board A between opposite side edges 22, 24 and are located along the top and bottom edges of each window 16 as well as along the top and bottom edges of each pocket 36. Magnet strips C, D are bonded to the inner surfaces of panels 10, 12 in the masked areas thereof between adjacent windows 16 and have substantially the same width as such masked areas. Magnet strips C, D are bonded to panels 10, 12 as by the use of adhesive or fusion, or by the use of plastic foam tape having pressure-sensitive adhesive on both opposite surfaces thereof.

Plastic strips C, D may comprise permanently magnetizable fine particles dispersed throughout a plastic binder. Magnet strips C, D may be magnetized to have the poles running longitudinally along the length thereof or transversely across the width thereof. Although both magnet strips C, D can be magnetized, it will be recognized that only one such strip need be magnetized while the other strip need simply comprise a material having a high magnetic permeability. Thus, and as herein utilized, reference to magnet strips is intended to cover both of the foregoing arrangements.

Figure 4:
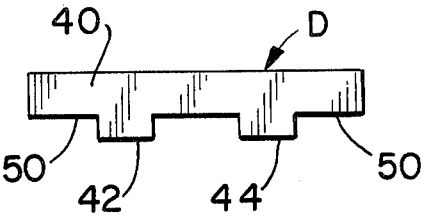
FIG. 4 is an end elevational view showing the cross-sectional shape of one magnet strip.
Figure 5:
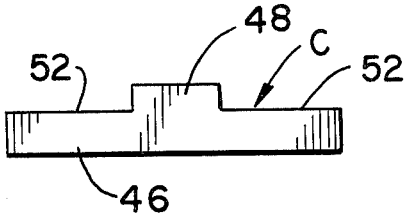
FIG. 5 is an end elevational view showing the cross-sectional shape of another magnet strip.

FIG. 4 shows magnet strip D as having a cross-sectional configuration including a substantially flat base 40 with a pair of spaced-apart legs 42, 44 extending outwardly therefrom and spaced inwardly from the edges of base 40. FIG. 5 shows magnet strip C as having a substantially flat base 46 with a central leg 48 extending outwardly therefrom. The width of leg 48 is slightly less than the spacing between legs 42, 44. Magnet strips C, D have magnet strip surfaces 50, 52 which oppose one another in spaced-apart relationship when magnet strips C, D engage one another with legs 48 received between legs 42, 44. Engagement of the outer ends of legs 42, 44 with base 46, and of the outer end of leg 48 with base 40 between legs 42, 44 effectively spaces strip surfaces 50, 52 from one another. These magnet strip surfaces 50, 52 cooperate with one another to define grooves extending along the entire length of the magnet strips.

As best shown in FIG. 2, these grooves are designated by numeral 60 and have a thickness measured perpendicular to panels 10, 12 which is substantially less than the thickness of a pocket 36 as measured perpendicular to the panels. In addition, and although the location could be modified to suit a particular need or purpose, grooves 60 are substantially centrally located between the inner surfaces of panels 10, 12. Grooves 60 extend along both the top and bottom edges of each pocket 36 in opposed cooperative relationship. Each pair of magnet strips define two opposed grooves 60 facing outwardly in opposite directions and with each groove being along an edge of a different pocket.

Rear panel 12 has suitable hanging devices on the rear surface thereof for hanging same to a wall. Hanging means may take many different forms, including hooks or adhesive tape, and may also be in the form of Velcro strips for cooperation with corresponding strips secured to a wall. When rear panel 12 is suspended on a vertical wall, front panel 10 would have a tendency to move transversely downwardly relative to rear panel 12. Projecting legs 48 on magnet strips C are received in the grooves defined between legs 42, 44 on the associated strips D to provide a mechanical interlock preventing such transverse movement. This mechanical interlock may be considered an interdigitating means for preventing transverse movement of the front panel relative to the rear panel. The holding means defined by the magnet strips C, D not only releasably hold panels 10, 12 together in spaced-apart relationship, but also cooperate with such panels for defining pockets 36.

Figure 6:
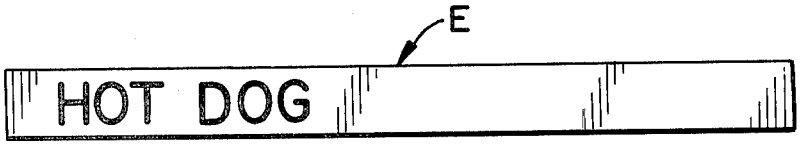
FIG. 6 is a front elevational view of a message bearing strip.

FIG. 6 shows a message bearing strip E which may be of various materials and is advantageously of synthetic plastic having a suitable legend imprinted thereon, e.g., "Hot Dog", as shown. As used herein, the term message bearing strip includes all types of members, panels, sheets, strips, and the like which bear written and/or visual indicia thereon and which are cooperable with sign board A in a manner to be described. Message bearing strip E has a thickness perpendicular to the plane of the drawing which is slightly less than the width of grooves 60 perpendicular to panels 10, 12. Message bearing strip E has a vertical height which is slightly less than the spacing between the bottoms of an opposed pair of grooves 60 along the top and bottom edges of a pocket 36. Thus, the message bearing strip E is easily inserted into an opposed pair of grooves 60 along the top and bottom edges of a pocket 36 for sliding the message bearing strip E into a pocket 36 so the message can be viewed through a window 16.

Figure 7:
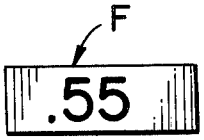
FIG. 7 is a front elevational view of another message bearing strip.

Message bearing strip F in FIG. 7 has a price such as "0.55" suitably imprinted thereon. Message bearing strip F may be of the same material as strip E, and has the same thickness and height dimensions. The combined length of message bearing strips E and F is approximately the same as the width of sign board A between opposite side edges 22, 24. Various different message bearing strips E, F may be inserted into pockets and removed therefrom as often as desired.

Figure 8:
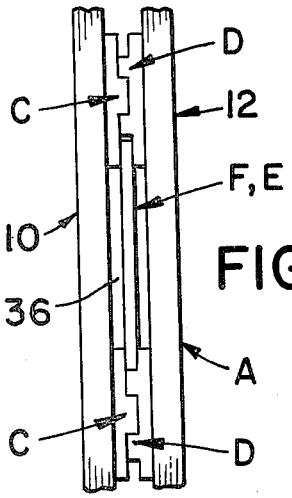
FIG. 8 is an end elevational view showing the message bearing strips of FIGS. 6 and 7 installed in a pocket; and, FIG. 9 is a partial front elevational view of the sign board showing the message bearing strips of FIGS. 6 and 7 installed in a pocket.

With the arrangement described, and as shown in FIG. 8, magnet strips C, D effectively define tracks in which message bearing strips E, F are guided as they are slid into and out of a pocket 36. Opposed grooves 60 hold message bearing strips E, F centrally between the inner surfaces of panels 10, 12 in spaced relationship to such surfaces. Persons who insert the message bearing strips may be careless and proceed to insert a message bearing strip into a pocket while the strip has food or other deposits thereon. In the arrangement shown and described, any deposits on the surfaces of the message bearing strips will not be wiped onto the inner surface of a window 16 because the outer surfaces of the message bearing strips are held in spaced relationship to the inner surface of a window.

Figure 9:
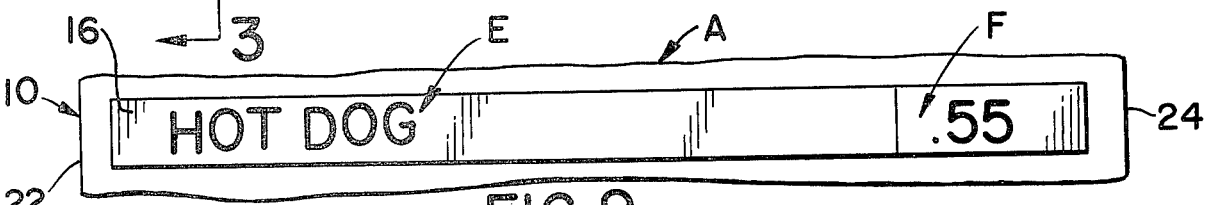

Message bearing strips E, F are also shown in an installed position in FIG. 9. To remove such strips, it is simply necessary to push on one end of one message bearing strip with another flat strip until the opposite end projects from a side edge 22, 24 and the strips can be pulled from the pocket.

With passage of time, airborne particles and the like will form a deposit within pockets 36 and particularly on the inner surfaces of windows 16. When it is desired to clean the inner surfaces of the sign board, it is simply necessary to pull outwardly on front panel C for swinging same upwardly and outwardly along hinge line 30 away from rear panel 12. The entire interior surfaces of the sign board may then be thoroughly cleaned. Reassembly of the sign board is accomplished by allowing front panel 10 to swing downwardly about hinge line 30 toward rear panel 12 until magnet strips C, D engage one another with legs 48 received between legs 42, 44.

Although panels 10, 12 are substantially rigid in the preferred structural arrangement shown, they have a thickness such that they will bend. This allows progressive separation of the magnet strips when panel 10 is pulled away from panel 12. That is, it is not necessary to break the entire holding force of all of the magnets or even one pair of magnets all at once. Gripping a bottom corner of front panel 10 allows same to be pulled outwardly while also bending outwardly so that the lower magnet strips are progressively pulled apart along the length thereof. The separation of strips then proceeds progressively upwardly. The holding force of the magnet strips is such that the panels are easily separated without requiring great strength. Moreover, and in addition to the retaining force of cooperating magnet strips C, D, it may be desirable in some sign installations to include secondary means for retaining the sign board in its assembled condition. Velcro strips strategically placed to cooperate with each other between the inside surfaces of panels 10,12 comprise one possible alternative for such secondary means.

The invention has been described with reference to a preferred embodiment. Obviously, modifications and alterations will occur to others upon the reading and understanding of this specification. It is intended to include all such modifications and alterations insofar as they come within the scope of the appended claims or the equivalents thereof.

Having thus described the invention, it is now claimed:

1. A sign board comprising: a pair of front and rear panels having top and bottom edges and opposite side edges, a plurality of pockets between said panels, said pockets being elongated between said side edges and being spaced-apart between said top and bottom edges, each said pocket being open along at least one of said side edges for installing a message bearing strip in each said pocket and removing same therefrom, transparent windows in said front panel aligned with said pockets, and, elongated magnet strips bonded to the inner surfaces of said panels along the top and bottom edges of each said pocket for performing the functions of releasably holding said panels together in spaced-apart relationship, spacing said panels from one another in substantially parallel spaced-apart relationship and defining the top and bottom edge portions of said pockets therebetween.

2. A sign board comprising: front and rear panels having top and bottom edges and opposite side edges; hinge means for hingedly connecting said panels together adjacent said top edges thereof; at least one pocket defined between said panels and opening along at least one of said side edges for installing a message bearing strip in said pocket and removing same therefrom with said front panel being substantially transparent at least in the area of said pocket, said pocket having a predetermined thickness between said panels and the top and bottom edges of said pocket having opposed grooves for receiving the top and bottom edges of a message bearing strip having a thickness substantially less than said predetermined thickness and holding such message bearing strip out of engagement with the inner surface of said front panel; and, cooperating releasable holding means on said panels for releasably holding same together, whereby different message bearing strips are readily slidable into and out of said pocket at frequent intervals without separating said panels, said holding means being releasable for swinging of said front panel away from said rear panel to expose said pocket for thorough cleaning between said panels.

3. The sign board as defined in claim 2 wherein said holding means comprises magnets interposed between said panels.

4. The sign board as defined in claim 2 wherein said hinge means comprises an elongated strip of plastic material longitudinally folded along a hinge line and having opposite hinge plate portions bonded to inner surfaces of said panels adjacent said top edges thereof with said hinge lines extending parallel to said top edges.

5. The sign board as defined in claim 4 wherein said rear panel is hangable to a vertical surface and said holding means includes interdigitating means for preventing downward transverse movement of said front panel relative to said rear panel.

6. A sign board comprising: a pair of front and rear panels having top and bottom edges and opposite side edges, a plurality of pockets between said panels, said pockets being elongated between said side edges and being spaced-apart between said top and bottom edges, each said pocket being open along at least one of said side edges for installing a message bearing strip in each said pocket and removing same therefrom, transparent windows in said front panel aligned with said pockets, elongated magnet strips bonded to the inner surfaces of said panels along the top and bottom edges of each said pocket for performing the dual functions of releasably holding said panels together in spaced-apart relationship and defining said pockets therebetween, said rear panel being hangable to a vertical surface, and, interdigitating means between said magnet strips for preventing downward transverse movement of said front panel relative to said rear panel.

7. A sign board comprising: opposed front and rear panels having opposed side edges, opposed top and bottom edges, and opposed inner surfaces, a plurality of elongated magnet strips interposed between said inner surfaces of said panels in spaced-apart relationship between said top and bottom edges and extending across said panels between said side edges thereof for releasably holding same together in substantially parallel spaced-apart relationship and for spacing said panels from one another in substantially parallel spaced-apart relationship, said magnet strips cooperating with said panel inner surfaces to define at least one pocket extending across said panels, said pocket having an open area adjacent at least one of said side edges for installing an indicia bearing member in said pocket and removing same therefrom, said pocket being completely covered by said front panel, said front panel being transparent at least along said pocket, said pocket having a predetermined thickness between said inner surfaces of said panels and said magnet strips being shaped for providing opposed grooves opening toward said pocket along the top and bottom edges thereof, and each said groove having a width measured in a direction perpendicular to said panels which is substantially less than said predetermined thickness.

8. The sign board as defined in claim 7 wherein said grooves are located for receiving top and bottom edges of an indicia bearing member and holding such member in spaced relationship to the inner surface of said front panel along said pocket.

9. The sign board as defined in claim 8 wherein said grooves are located substantially centrally between the inner surfaces of said panels.

10. The sign board as defined in claim 8 wherein said magnet strips are in a plurality of opposed pairs and said grooves are defined between opposed strip surfaces on each opposed pair of magnet strips.

11. The sign board as defined in claim 10 wherein said pairs of magnet strips have interdigitating tongues and grooves thereon.

12. A sign board comprising: a pair of front and rear panels having top and bottom edges and opposite side edges, a plurality of pockets between said panels, said pockets being elongated between said side edges and being spaced-apart between said top and bottom edges, each said pocket being open along at least one of said side edges for installing a message bearing strip in each said pocket and removing same therefrom, transparent windows in said front panel aligned with said pockets, elongated magnet strips bonded to the inner surfaces of said panels along the top and bottom edges of each said pocket for performing the functions of releasably holding said panels together in spaced-apart relationship, spacing said panels from one another in substantially parallel spaced-apart relationship and defining the top and bottom edge portions of said pockets therebetween, said magnet strips having cooperating opposed longitudinal grooves therein facing toward said pockets for receiving the top and bottom edges of a message strip, and said grooves being located for holding such strips in said pockets in spaced relationship to the inner surface of said front panel.

13. The sign board as defined in claim 12 wherein said magnet strips are in a plurality of opposed pairs and said grooves are defined by a rabbet in at least one strip of each pair.

14. A sign board comprising: a pair of front and rear panels having top and bottom edges and opposite side edges, a plurality of pockets between said panels, said pockets being elongated between said side edges and being spaced-apart between said top and bottom edges, each said pocket being open along at least one of said side edges for installing a message bearing strip in each said pocket and removing same therefrom, transparent windows in said front panel aligned with said pockets, elongated magnet strips bonded to the inner surfaces of said panels along the top and bottom edges of each said pocket for performing the functions of releasably holding said panels together in spaced-apart relationship, spacing said panels from one another in substantially parallel spaced-apart relationship and defining the top and bottom edge portions of said pockets therebetween, said magnet strips being in a plurality of opposed pairs and said strips in each said pair having interdigitating tongues and grooves.

15. A sign board comprising: a pair of front and rear panels having top and bottom edges and opposite side edges, a plurality of pockets between said panels, said pockets being elongated between said side edges and being spaced-apart between said top and bottom edges, each said pocket being open along at least one of said side edges for installing a message bearing strip in each said pocket and removing same therefrom, transparent windows in said front panel aligned with said pockets, elongated magnet strips bonded to the inner surfaces of said panels along the top and bottom edges of each said pocket for performing the functions of releasably holding said panels together in spaced-apart relationship, spacing said panels from one another in substantially parallel spaced-apart relationship and defining the top and bottom edge portions of said pockets therebetween, said magnet strips being in opposed pairs, one strip in each said pair being generally T-shaped in cross-section and the other of said strips in each said pair having a cross-sectional shape including a substantially flat base having a pair of spaced-apart legs extending outwardly from one side thereof at locations spaced inwardly from the longitudinal edges thereof.

* * * * *